US006669082B1

(12) United States Patent
Meyer

(10) Patent No.: US 6,669,082 B1
(45) Date of Patent: Dec. 30, 2003

(54) COMPRESSION SUPPORTING PACKAGE DIVIDER SET

(75) Inventor: John S. Meyer, Hillsboro, OR (US)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/320,584

(22) Filed: Dec. 16, 2002

(51) Int. Cl.[7] ..... B65D 5/48

(52) U.S. Cl. ..... 229/120.36; 229/120.29; 493/91; 493/162

(58) Field of Search ..... 229/120.26, 120.29, 229/120.31, 120.33, 120.34, 120.36; 217/30, 31, 32, 33; 493/56, 90, 91, 162

(56) References Cited

U.S. PATENT DOCUMENTS

| | | | | |
|---|---|---|---|---|
| 1,120,752 A | | 12/1914 | Smiley | |
| 1,306,796 A | | 6/1919 | Boswell et al. | |
| 1,704,948 A | | 3/1929 | Maston | |
| 1,842,380 A | | 1/1932 | Andrews | |
| 1,994,318 A | | 3/1935 | Loth | |
| 2,450,801 A | | 10/1948 | Huye | |
| 2,643,810 A | | 6/1953 | Fleming | |
| 2,706,935 A | | 4/1955 | Pasjack | |
| 2,749,014 A | * | 6/1956 | Russell et al. | 229/120.36 |
| 3,039,667 A | | 6/1962 | Kozlik | |
| 3,580,471 A | * | 5/1971 | Burke et al. | 217/30 |
| 3,675,345 A | | 7/1972 | Abrams | |
| 3,826,357 A | * | 7/1974 | Roth | 229/120.36 |
| 3,880,343 A | * | 4/1975 | Rockefeller | 229/120.26 |
| 3,942,709 A | | 3/1976 | Gepfer | |
| 3,942,837 A | | 3/1976 | Engle | |
| 4,361,264 A | | 11/1982 | Philips | |
| 5,282,567 A | | 2/1994 | Dickson | |

FOREIGN PATENT DOCUMENTS

| | | | | |
|---|---|---|---|---|
| GB | 2055349 A | * | 3/1981 | 229/120.36 |

* cited by examiner

*Primary Examiner*—Gary E. Elkins
(74) *Attorney, Agent, or Firm*—Mark P. Watson

(57) ABSTRACT

A compression supporting package divider set. Within the scope of the invention, there is a divider having an upper edge and a spaced-apart lower edge, the upper and lower edges being connected by a side edge forming an end of the divider. A cut line extends from one of the upper and lower edges to an interior point of the divider spaced from the upper and lower edges and from the side edge. A fold line for folding the divider defines an axis of rotation intersecting the upper and lower edges and terminates at the interior point. The fold line is provided such that a first side flange portion of the divider defined between the cut line and the axis of rotation rotates about the axis together with a second side flange portion of the divider defined between the fold line and the side edge, thereby causing the first and second side flange portions to extend on opposite sides of the divider.

20 Claims, 6 Drawing Sheets

COMPRESSION SUPPORTING PACKAGE DIVIDER SET

The present invention relates to a compression supporting package divider set, particularly for use in corrugated paperboard packaging systems.

Economical packaging systems for shipping multiple articles in a shipping container often make use of corrugated paperboard divider sets to partition the shipping container into individual compartments for separating the articles. Typically, the dividers are slotted and interlock with one another to provide interior cells and periphery cells, where the interior cells are bound on all sides by the dividers, but where the periphery cells are open at sides thereof that are adjacent the walls of the container. For example, a nine-cell divider set is typically formed by two parallel dividers oriented in one direction and two parallel dividers oriented in the perpendicular direction. Only one of the nine cells is an interior cell bound on all sides by the four dividers. Four of the remaining eight cells are corner cells bound on two sides by a respective intersecting pair of walls of the shipping container, and the remaining four of the eight cells are bound on one side by a respective wall of the shipping container. Each of the four dividers has two ends for a total of eight ends corresponding to the eight periphery cells.

While economical, the divider set is weak at the ends of the dividers with respect to compressive forces tending to buckle the dividers. Additional dividers could be provided at the ends of the existing dividers to support the ends, adjacent the walls of the shipping container, but this increases material as well as manufacturing and assembly labor costs.

A straight-forward and economical solution to the problem is simply to bend the dividers 90 degrees at the ends, to provide a flanged supporting portion that distributes compression stress over a plane as opposed to a line. A problem with this approach is that such a supporting portion can only be provided on one side of the divider. Any stress tending to bend the divider away from the supporting portion, in the other direction, remains unsupported.

Another approach to the problem is to bend the dividers 180 degrees at their ends, to stiffen the dividers at the ends against buckling. A problem with this approach is that the desired degree of stiffening may not be obtainable from the material used for the dividers unless multiple bends are made, which again add material, manufacturing and labor costs. Stiffening the dividers against buckling by making them thicker is inherently a less efficient means for strengthening the structure than providing the structure with flanges that extend the area over which the structure is supported. The difference may be appreciated by comparing the stiffness of an I-beam with that of a cylindrical rod having the same amount of material.

Accordingly, there is a need for a compression supporting package divider set that provides for increasing the strength of the dividers at unsupported ends at the lowest cost.

SUMMARY OF THE INVENTION

Disclosed is a compression supporting package divider set. Within the scope of the invention, there is a divider having an upper edge and a spaced-apart lower edge, the upper and lower edges being connected by a side edge forming an end of the divider. A cut line extends from one of the upper and lower edges to an interior point of the divider spaced from the upper and lower edges and from the side edge. A fold line for folding the divider defines an axis of rotation intersecting the upper and lower edges and terminates at the interior point. The fold line is provided such that a first side flange portion of the divider defined between the cut line and the axis of rotation rotates about the axis together with a second side flange portion of the divider defined between the fold line and the side edge, thereby causing the first and second side flange portions to extend on opposite sides of the divider.

Therefore, it is an object of the present invention to provide a novel and improved compression supporting package divider set.

The foregoing and other objects, features and advantages of the present invention will be more readily understood upon consideration of the following detailed description of the invention, taken in conjunction with the following drawings.

DETAILED DESCRIPTION

Figure 1:
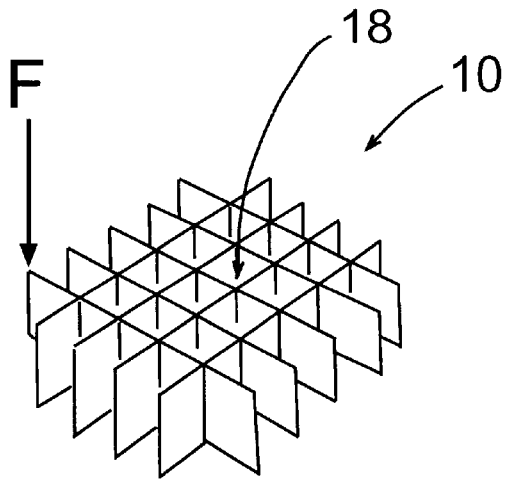
(PRIOR ART) FIG. 1
FIG. 1 is a pictorial view of a prior art divider set.
Figure 2:
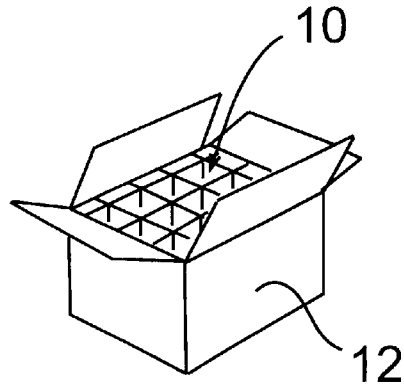
(PRIOR ART) FIG. 2
FIG. 2 is a pictorial view of the divider set of FIG. 1 installed in a shipping container.
Figure 3:
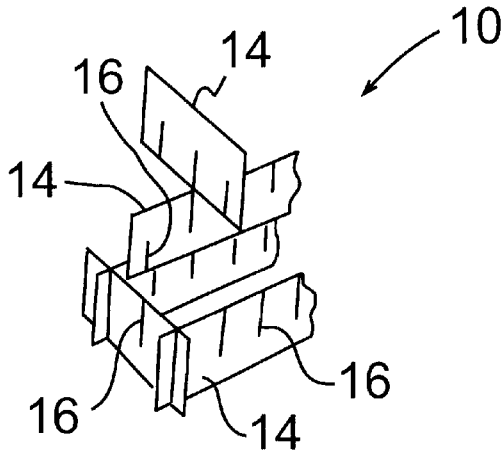
(PRIOR ART) FIG. 3
FIG. 3 is an exploded pictorial view of the divider set of FIG. 1.

FIG. 1 shows an exemplary prior art package divider set 10. As shown in FIG. 2, the divider set 10 is provided for installation in a shipping or packing container or carton 12 ("shipping container"). As shown in FIG. 3, the divider set includes a plurality of planar, corrugated paperboard dividers 14 that are provided with interlocking slots 16 for forming one or more cells or compartments 18 (FIG. 1) for receiving articles in the shipping container.

Figure 4:
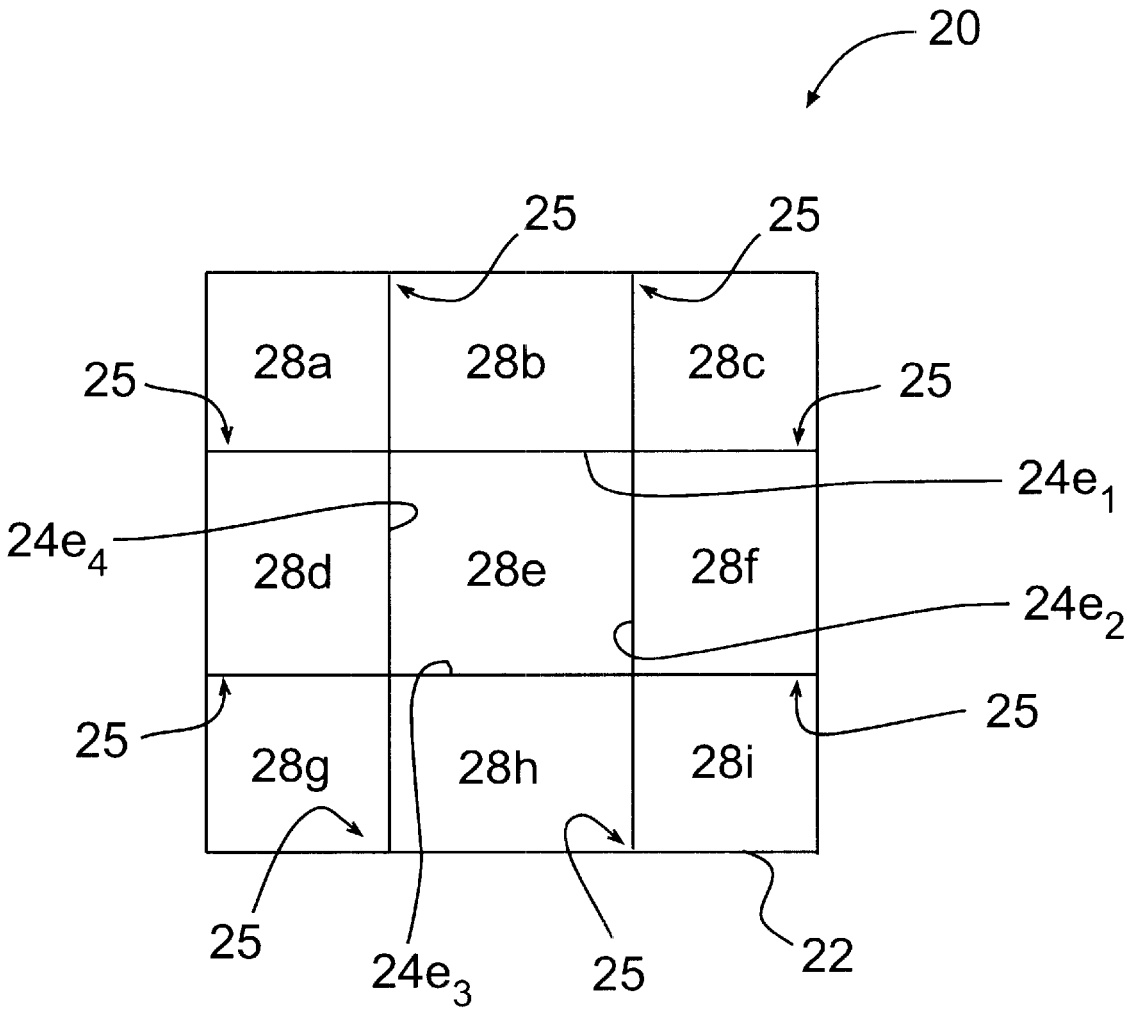
(PRIOR ART) FIG. 4
FIG. 4 is a plan view of a prior art divider set.

Referring to FIG. 4, a plan view of a simple divider set 20 comprising four planar dividers 24 is shown. The divider set defines nine cells or compartments 28*a*–28*i*. In this example, the cell 28*e* is the only cell that is fully enclosed by the dividers ("interior cell"), here by the four walls $\mathbf{24}e_1$–$\mathbf{24}e_4$ provided by the dividers 24. The remaining cells are "periphery cells" for which at least one of the enclosing walls is provided by a shipping container 22. Each of the four dividers has two unsupported ends 25. The unsupported ends may buckle if a compressive force is applied to the ends in the direction perpendicular to the plane of the Figure (corresponding to the direction of the arrow "F" in FIG. 1).

Figure 5:
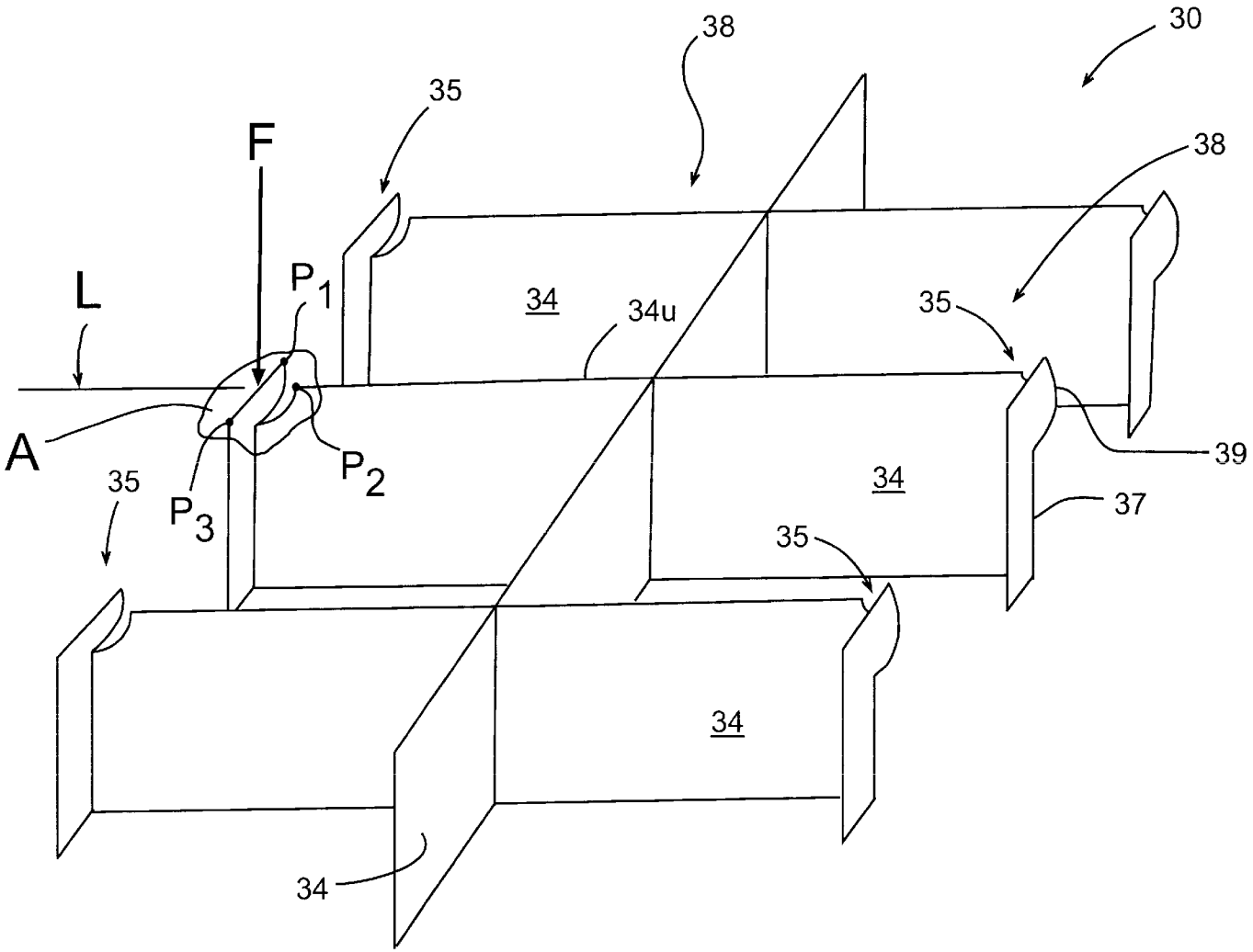
FIG. 5 is a pictorial view of a compression supporting package divider set according to the present invention.

Turning to FIG. 5, a compression supporting package divider set 30 according to the present invention is shown. The divider set 30 in this example employs four dividers 34 to form eight cells 38. The number of dividers or cells is not pertinent to the invention, nor is the lack of interior cells. Each of the dividers has two unsupported ends 35; however, the unsupported ends are flanged to distribute compressive force applied to the unsupported ends in the direction of the arrow "F" over an area "A" defined by at least three points $P_1$, $P_2$ and $P_3$ which are not collinear, where one of the points $P_2$ lies on a line "L" defining an upper edge 34*u* of the divider, and the other points $P_1$ and $P_3$ lie on either side of the line "L."

Figure 6:
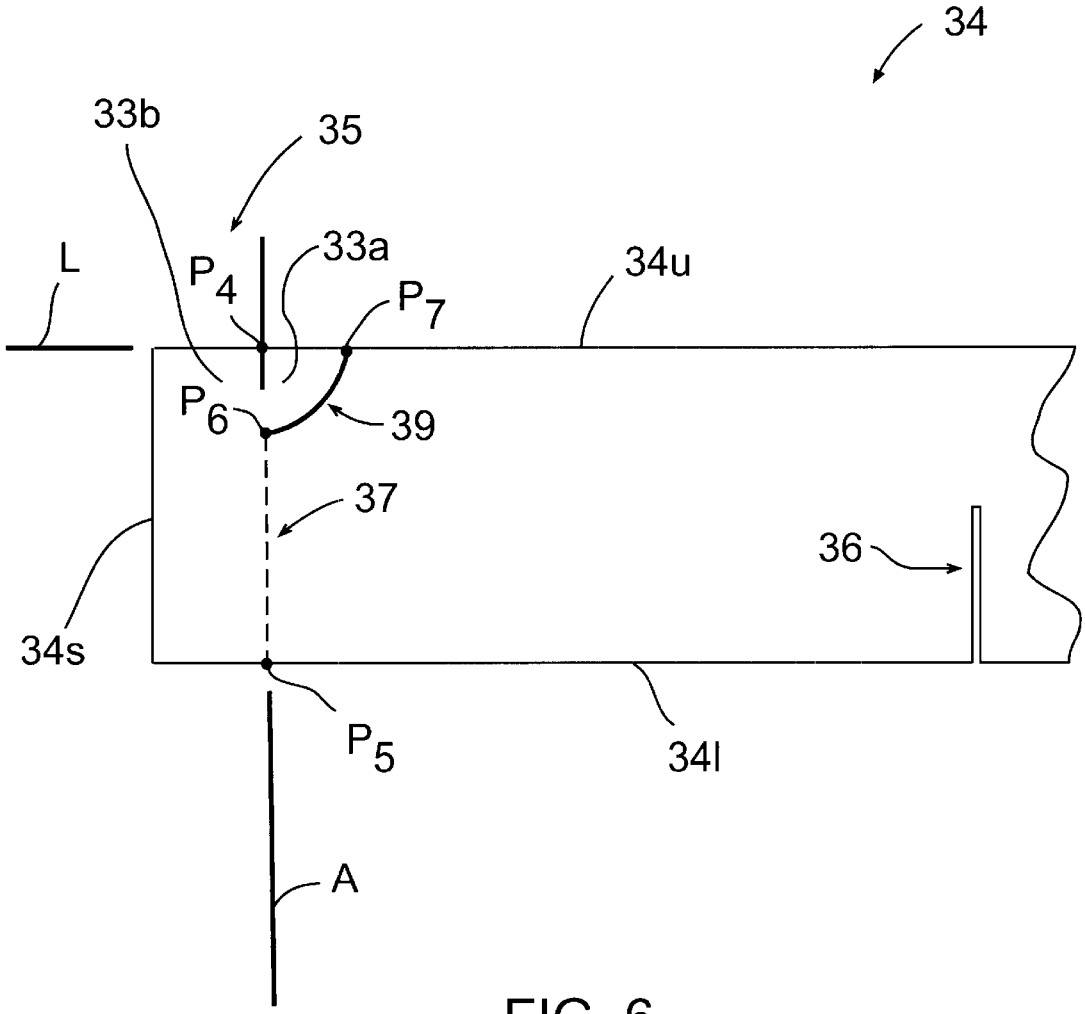
FIG. 6 is an elevational view of a divider of the divider set of FIG. 5 showing one flanged end according to the invention.

Referring to FIG. 6, a portion of one of the dividers 34 of FIG. 5 is shown. A slot 36 is provided to interlock with another divider such as shown in FIG. 3. The divider 34 has an upper edge 34*u*, a lower edge 34*l* spaced apart from the upper edge, and a side edge 34*s* connecting the upper and lower edges and forming the unsupported end 35 of the divider.

According to the invention, a flange is defined at the end 35 by providing a fold line 37 and a cut line 39. The fold line defines an axis of rotation "A" that intersects the upper edge 34*u* at a point $P_4$ and the lower edge 34*l* at a point $P_5$. The fold line extends from a point on the divider that is spaced from the side edge 34*s*, here the point $P_5$. The fold line terminates at an interior point $P_6$ that is spaced from the upper and lower edges, and from the side edge 34*s*.

The cut line 39 extends from the interior point $P_6$ to a point $P_7$ on one of the upper and lower edges, here the upper edge 34*u*. Cutting the divider along the cut line (thereby creating the points $P_1$ and $P_2$ in FIG. 5 from the point $P_7$ in FIG. 6) and folding the divider along the fold line creates two side flange portions 33*a* and 33*b* that rotate together about the axis "A." The first side flange portion 33*a* is defined between the cut line and the axis "A," and the second side flange portion 33*b* of the divider is defined between the fold line and the side edge 34*s*. This rotation causes the first and second side flange portions to extend on opposite sides of the line "L" as shown in FIG. 5.

It may be noted that the point $P_7$ is on one side of the axis "A" and the side edge 34*s* is on the other side. If this were not the case, the aforedescribed rotation of the first side flange portion 33*a* would not occur.

Figure 7:
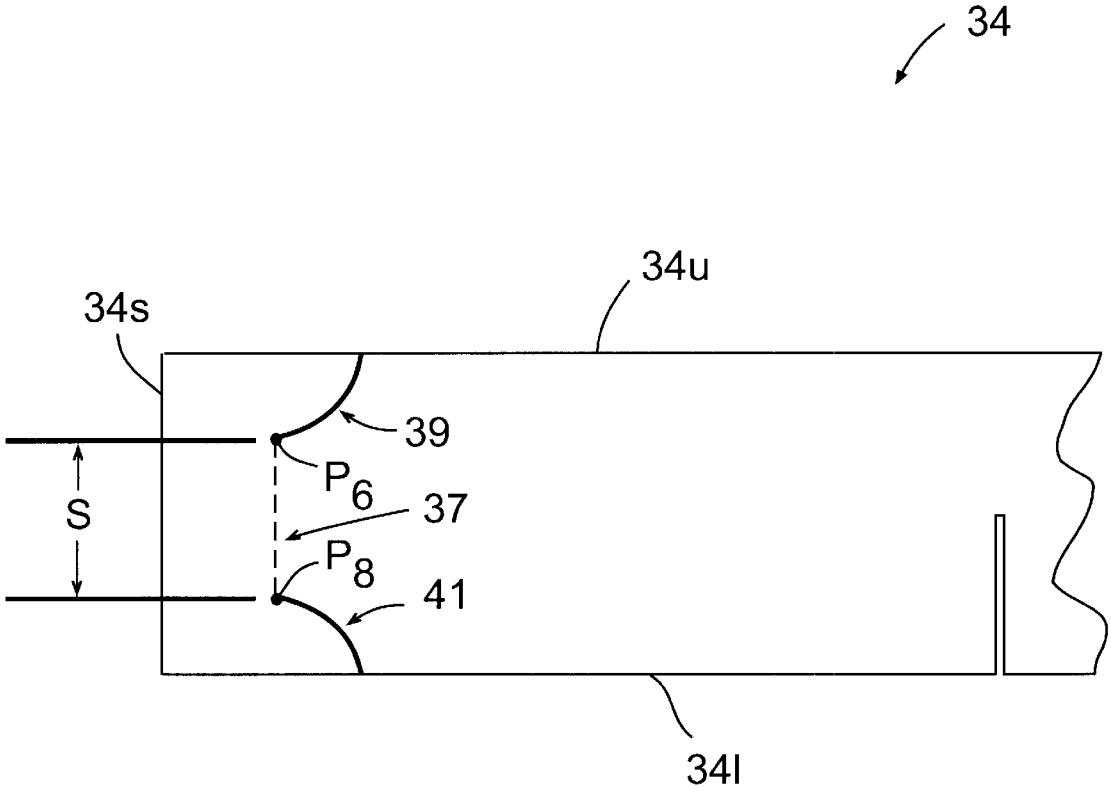
FIG. 7 is an elevational view of a divider of the divider set of FIG. 5 showing two opposite flanged ends according to the invention.

Turning to FIG. 7, a similar flange as described in connection with FIG. 6 may be created by use of a cut line 41 extending from the point $P_8$ to the lower edge 34*l* of the divider 34, where the fold line 37 extends from the point $P_8$ (instead of the point $P_5$ in FIG. 6) to the point $P_6$. The cut line 41 may be provided as an alternative to the cut line 39 or in addition as shown. Preferably, the fold line extends a distance "s" that is at least about half of the length of the side edge 34*s* to maintain torsional rigidity of the divider 34.

As will be readily appreciated, the cut line may have any shape, and may be curvilinear as shown or rectilinear, or may be a combination of curvilinear lines, rectilinear lines, or both. The cut line is preferably though not necessarily pre-cut, and the fold line is preferably preformed such as by being scored or weakened to facilitate folding during assembly of the divider set.

Figure 8:
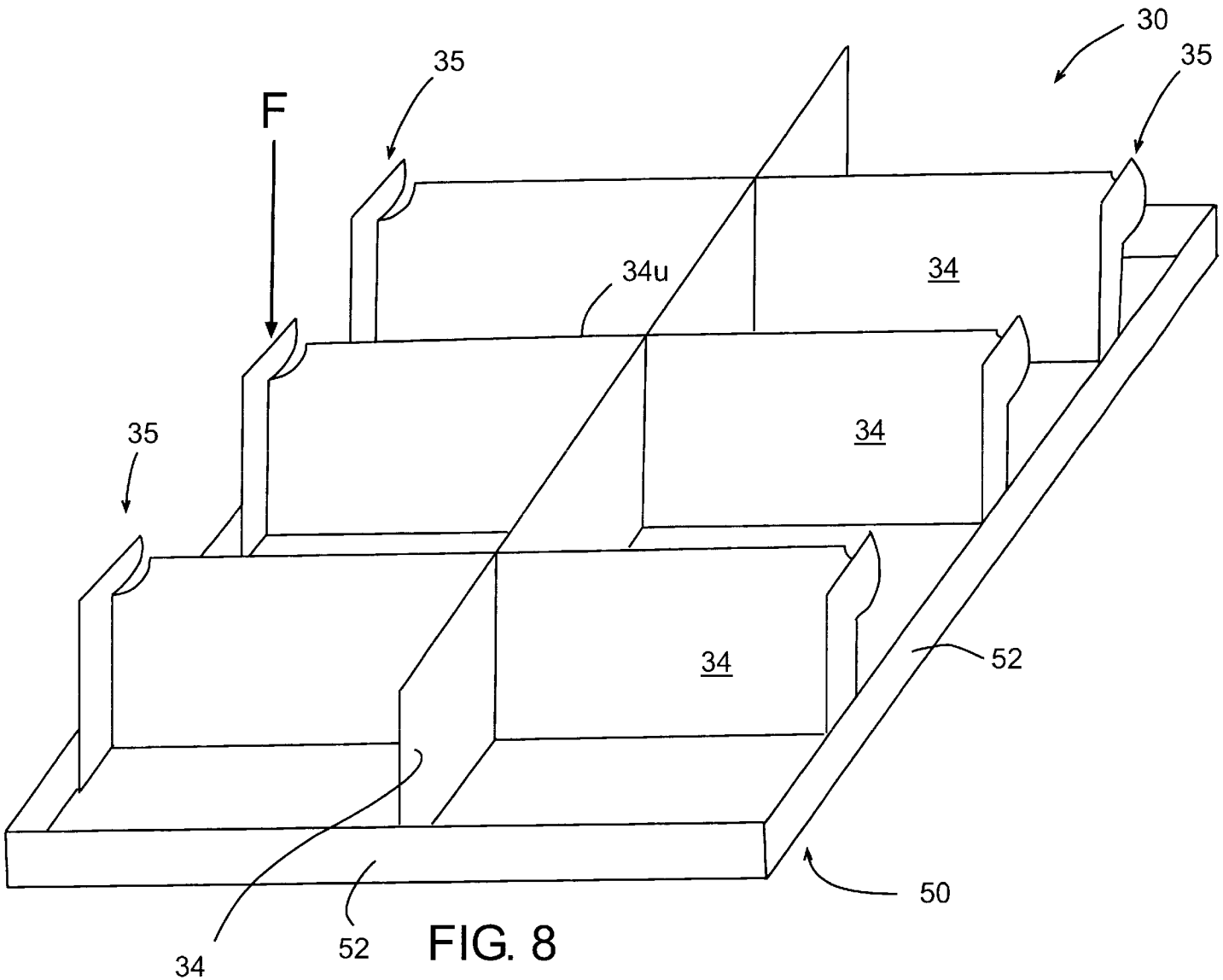
FIG. 8 is a pictorial view of the compression supporting package divider set of FIG. 5 in a shipping container according to the present invention.

A package divider set according to the present invention may be adapted to fit within and partition a shipping container that supplies at least one of the walls for enclosing periphery cells of the assembled divider set in the manner shown in FIG. 2. However, referring to FIG. 8, the invention is particularly advantageous when employed in a shipping container such as that referenced as 50 which provides a platform for the divider set but which does not wholly contain the divider set. The shipping container 50 should preferably have the side-walls 52 that do not extend above the elevation of the dividers 34 so that the unsupported ends 35 of the dividers are not protected by the shipping container and are left maximally exposed to receiving compressive forces "F." However, the side-walls 52 are not necessary.

It is to be recognized that, while a particular compression supporting package divider set has been shown and described as preferred, other configurations and methods could be utilized, in addition to those already mentioned, without departing from the principles of the invention. For example, while described in the preferred context of a corrugated paperboard divider set for use with a corrugated shipping container, any material or materials may be used for either the divider set or the shipping container without departing from the principles of the invention.

The terms and expressions which have been employed in the foregoing specification are used therein as terms of description and not of limitation, and there is no intention of the use of such terms and expressions of excluding equivalents of the features shown and described or portions thereof, it being recognized that the scope of the invention is defined and limited only by the claims which follow.

What is claimed is:

1. A compression supporting divider set comprising a divider having an upper edge and a spaced-apart lower edge, said upper and lower edges each terminating at a side edge forming an end of said divider, said divider further comprising a fold line extending between a first interior point on said divider proximate said upper edge and a second interior point on said divider proximate said lower edge, said first and second interior points spaced from said upper, lower, and side edges, said fold line defining a folding axis of rotation for said end of said divider that passes through a first point of intersection with said upper edge, and a first cut line extending from said first interior point to a first edge point on said upper edge that is on a side of said folding axis that is opposite said side edge, wherein a first portion of said upper edge defined between said first edge point and said first point of intersection and a second portion of said upper edge defined between said first point of intersection and said side edge are provided such that folding said divider along said fold line extends said first and second portions of said upper edge outwardly from said divider in opposite directions.

2. The divider set of claim 1, further comprising a shipping container, wherein said divider set is adapted to partition said shipping container into a plurality of cells.

3. The divider set of claim 1, wherein said divider is formed of paperboard.

4. The divider set of claim 3, further comprising a shipping container, wherein said divider set is adapted to partition said shipping container into a plurality of cells.

5. The divider set of claim 1, wherein said divider is formed of corrugated paperboard.

6. The divider set of claim 5, further comprising a shipping container, wherein said divider set is adapted to partition said shipping container into a plurality of cells.

7. The divider set of claim 1, wherein said folding axis passes through a second point of intersection with said lower edge, further comprising a second cut line extending from said second interior point to a second edge point on said lower edge that is on a side of said folding axis that is opposite said side edge, wherein a first portion of said lower edge defined between said second edge point and said second point of intersection and a second portion of said lower edge defined between said second point of intersection and said side edge are provided such that folding said divider along said fold line extends said first and second portions of said lower edge outwardly from said divider in opposite directions.

8. The divider set of claim 7, further comprising a shipping container, wherein said divider set is adapted to partition said shipping container into a plurality of cells.

9. The divider set of claim 7, wherein said divider is formed of paperboard.

10. The divider set of claim 9, further comprising a shipping container, wherein said divider set is adapted to partition said shipping container into a plurality of cells.

11. The divider set of claim 7, wherein said divider is formed of corrugated paperboard.

12. The divider set of claim 11, further comprising a shipping container, wherein said divider set is adapted to partition said shipping container into a plurality of cells.

13. The divider set of claim 7, wherein said side edge is linear and said folding axis is parallel to said side edge.

14. The divider set of claim 13, further comprising a shipping container, wherein said divider set is adapted to partition said shipping container into a plurality of cells.

15. The divider set of claim 13, wherein said divider is formed of corrugated paperboard.

16. The divider set of claim 15, further comprising a shipping container, wherein said divider set is adapted to partition said shipping container into a plurality of cells.

17. The divider set of claim 13, wherein said divider is formed of paperboard.

18. The divider set of claim 17, further comprising a shipping container, wherein said divider set is adapted to partition said shipping container into a plurality of cells.

19. A method for packaging one or more articles, comprising the steps of:

providing a divider having an upper edge and a spaced-apart lower edge, said upper and lower edges being connected by a side edge forming an end of said divider;

cutting a line extending from one of said upper and lower edges to an interior point of said divider spaced from said upper and lower edges and from said side edge; and folding said divider along a fold line defining an axis of rotation intersecting said upper and lower edges and terminating at said interior point such that a first side flange portion of the divider defined between said cut line and said axis rotates about said axis together with a second side flange portion of the divider defined between said fold line and said side edge, thereby causing said first and second side flange portions to extend on opposite sides of said divider.

20. The method of claim 19, further comprising providing a plurality of said divider to form a divider set and installing the divider set in a shipping container so that the divider set partitions the shipping container into a plurality of cells.

* * * * *